US007345884B2

(12) United States Patent
Horng et al.

(10) Patent No.: US 7,345,884 B2
(45) Date of Patent: Mar. 18, 2008

(54) HEAT-DISSIPATING FAN

(75) Inventors: Alex Horng, Kaohsiung (TW); Hao-An Shieh, Kaohsiung Hsien (TW); Pei-Wei Lo, Kaohsiung (TW)

(73) Assignee: Sunonwealth Electic Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 11/374,085

(22) Filed: Mar. 14, 2006

(65) Prior Publication Data

US 2007/0217149 A1 Sep. 20, 2007

(51) Int. Cl.
*H05K 7/20* (2006.01)
*F28D 15/00* (2006.01)

(52) U.S. Cl. ..... 361/719; 361/695; 165/104.33; 415/211.2

(58) Field of Classification Search ..... 361/695, 361/697, 719, 694; 417/423.1, 352–354, 417/366; 415/176, 178, 211.2, 220; 165/122, 165/104.33
See application file for complete search history.

(56) References Cited

U.S. PATENT DOCUMENTS

| | | | | |
|---|---|---|---|---|
| RE34,268 | E | 6/1993 | Müller | |
| 5,629,560 | A * | 5/1997 | Katsui et al. | 257/712 |
| 5,947,691 | A * | 9/1999 | Brown et al. | 417/44.1 |
| 5,979,541 | A * | 11/1999 | Saito | 165/80.3 |
| 6,050,785 | A * | 4/2000 | Horng | 417/354 |
| 6,109,890 | A * | 8/2000 | Horng | 417/423.14 |
| 6,132,170 | A * | 10/2000 | Horng | 415/178 |
| 6,179,561 | B1 * | 1/2001 | Horng | 415/208.3 |
| 6,309,190 | B1 * | 10/2001 | Chen | 417/423.1 |
| 6,400,050 | B1 * | 6/2002 | Naman et al. | 310/68 B |
| 6,400,053 | B1 * | 6/2002 | Horng | 310/91 |
| 6,527,522 | B2 * | 3/2003 | Chen | 417/355 |
| 6,841,957 | B2 * | 1/2005 | Brown | 318/254 |
| 7,044,721 | B2 * | 5/2006 | Horng et al. | 417/423.7 |
| 7,121,697 | B2 * | 10/2006 | Hsu | 362/386 |
| 7,154,750 | B2 * | 12/2006 | Li et al. | 361/695 |
| 2004/0202560 | A1 * | 10/2004 | Lin et al. | 417/423.7 |
| 2004/0257774 | A1 * | 12/2004 | Lin | 361/719 |
| 2005/0063822 | A1 * | 3/2005 | Horng et al. | 415/211.2 |
| 2006/0012255 | A1 | 1/2006 | Ku et al. | |

FOREIGN PATENT DOCUMENTS

JP 2000099209 A * 4/2000

* cited by examiner

*Primary Examiner*—Jayprakash Gandhi
*Assistant Examiner*—Robert J Hoffberg
(74) *Attorney, Agent, or Firm*—Birch, Stewart, Kolasch & Birch, LLP

(57) ABSTRACT

A heat-dissipating fan includes a housing, an impeller, and a circuit board. The housing includes an air channel and a base. The base is mounted in one end of the air channel for supporting the circuit board. The impeller is rotatably mounted on the base and includes a hub and a plurality of blades. The circuit board includes at least one heat-generating electronic element mounted thereon. The heat-generating electronic element extends out of the hub in relation to a longitudinal direction of the housing, with at least one portion of the heat-generating electronic element located on a downstream side of the blades for dissipating heat generated by the heat-generating electronic element.

5 Claims, 5 Drawing Sheets

HEAT-DISSIPATING FAN

BACKGROUND OF THE INVENTION

1. Field of the Invention

The present invention relates to a heat-dissipating fan and more particularly to a heat-dissipating fan for lowering temperature of at least one heat-generating electronic element by mounting the heat-generating electronic element on a downstream side of the blades of an impeller of the heat-dissipating fan.

2. Description of Related Art

A conventional heat-dissipating fan, as illustrated in FIG. 1 of the drawings, comprises a housing 1, an impeller 2, and a circuit board 3. The housing 1 comprises an air channel 10, an air inlet 11, an air outlet 12, and a base 13, and further accommodates a stator 14. The impeller 2 is received in the air channel 10. Air currents enter the air channel 10 via the air inlet 11 and exit the air channel 10 via the air outlet 12. The circuit board 3 and the stator 14 are mounted on the base 13, which is mounted on the air outlet 12 side. The impeller 2 is coupled to the base 13 and comprises a hub 21, a shaft 22, a plurality of blades 23, and an annular magnet 24. The hub 21 is substantially inverted bowl-like. The shaft 22 extends from a center of an inner face of the hub 21 and is rotatably connected with the base 13. The blades 23 are annularly provided on an outer periphery of the hub 21. The circuit board 3 comprises a sensor 31 and at least one heat-generating electronic element 32 that controls alternate energizing of the stator 14. In operation, the annular magnet 24 drives the impeller 2 to turn based on the alternate energizing. Hence, the blades 23 drive air currents to flow from the air inlet 11 side to the air outlet 12 side.

The electronic element 32 such as a transistor that uses semi-conductive metal/non-metal blending material to control the gating direction of the electric current consumes electricity and generates heat. The electronic element 32 is generally mounted in a range of the base 13 and the hub 21 and lacks mechanism for dissipating the heat generated by the electronic element 32, resulting in excessively high temperature and adversely affecting operational stability of the electronic element 32 and even shortening the life of the heat-dissipating fan.

OBJECTS OF THE INVENTION

An object of the present invention is to provide a heat-dissipating fan with improved heat-dissipating efficiency for the electronic element, thereby prolonging the life of the heat-dissipating fan.

Another object of the present invention is to provide a heat-dissipating fan that provides a turbulence-reducing effect and that has a low noise during operation.

SUMMARY OF THE INVENTION

A heat-dissipating fan in accordance with the present invention comprises a housing, an impeller, and a circuit board. The housing comprises an air inlet, an air channel, an air outlet, and a base. The air inlet and the air outlet are respectively at two ends of the air channel. The base is mounted in one of the ends of the air channel. The impeller is rotatably mounted on the base and comprises a hub and a plurality of blades. The circuit board is mounted on the base and comprises at least one heat-generating electronic element mounted thereon. The at least one heat-generating electronic element extends out of the hub in relation to a longitudinal direction of the housing, with at least one portion of the at least one heat-generating electronic element located on a downstream side of the blades for dissipating heat generated by the at least one heat-generating electronic element.

Preferably, the circuit board is a rigid printed circuit board or a flexible printed circuit board.

Preferably, the circuit board comprises at least one extension extending radially outward from the circuit board, and the at least one heat-generating electronic element is mounted on the at least one extension.

Preferably, the at least one heat-generating electronic element is mounted on an end of the at least one extension that is adjacent to the impeller.

Preferably, the base further comprises at least one notch through which the at least one extension and the at least one heat-generating electronic element extend.

Preferably, a plurality of ribs are mounted between the base and an inner periphery delimiting the air channel, at least one of the ribs being aligned with said at least one notch, allowing said at least one extension and said at least one heat-generating electronic element to extend to said at least one rib.

Preferably, the at least one rib comprises a wire-guiding groove and a wire-guiding notch for receiving a wire connected to the circuit board, and the at least one notch of the base is aligned with the at least one rib with the wire-guiding groove.

Preferably, an axial tube is mounted to a center of the base, and at least one bearing is mounted in the axial tube for coupling with the impeller.

Preferably, the circuit board further comprises a hole in a center thereof for coupling with the axial tube of the base.

Preferably, wherein the circuit board further comprises at least one sensor. The hub of the impeller further comprises an annular magnet. The at least one sensor is aligned with an end of the annular magnet.

Preferably, the at least one heat-generating electronic element is a transistor or an integrated circuit.

Preferably, the at least one heat-generating electronic element is a field-effect transistor or a metal-oxide semiconductor.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
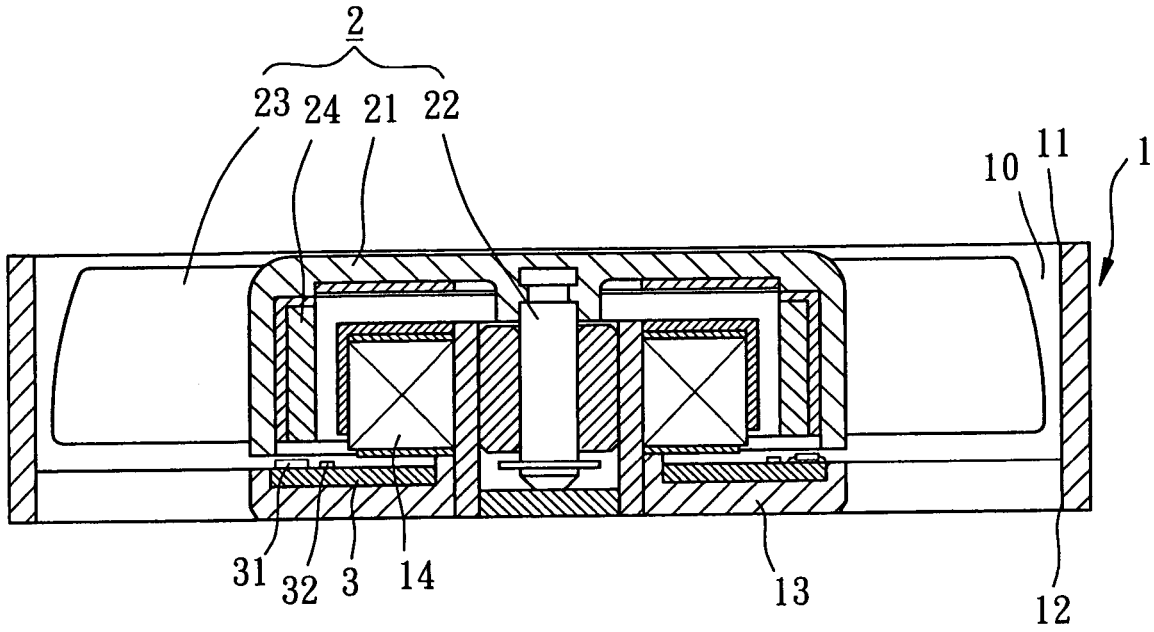
FIG. 1 PRIOR ART
FIG. 1 is a sectional view of a conventional heat-dissipating fan.
Figure 2:
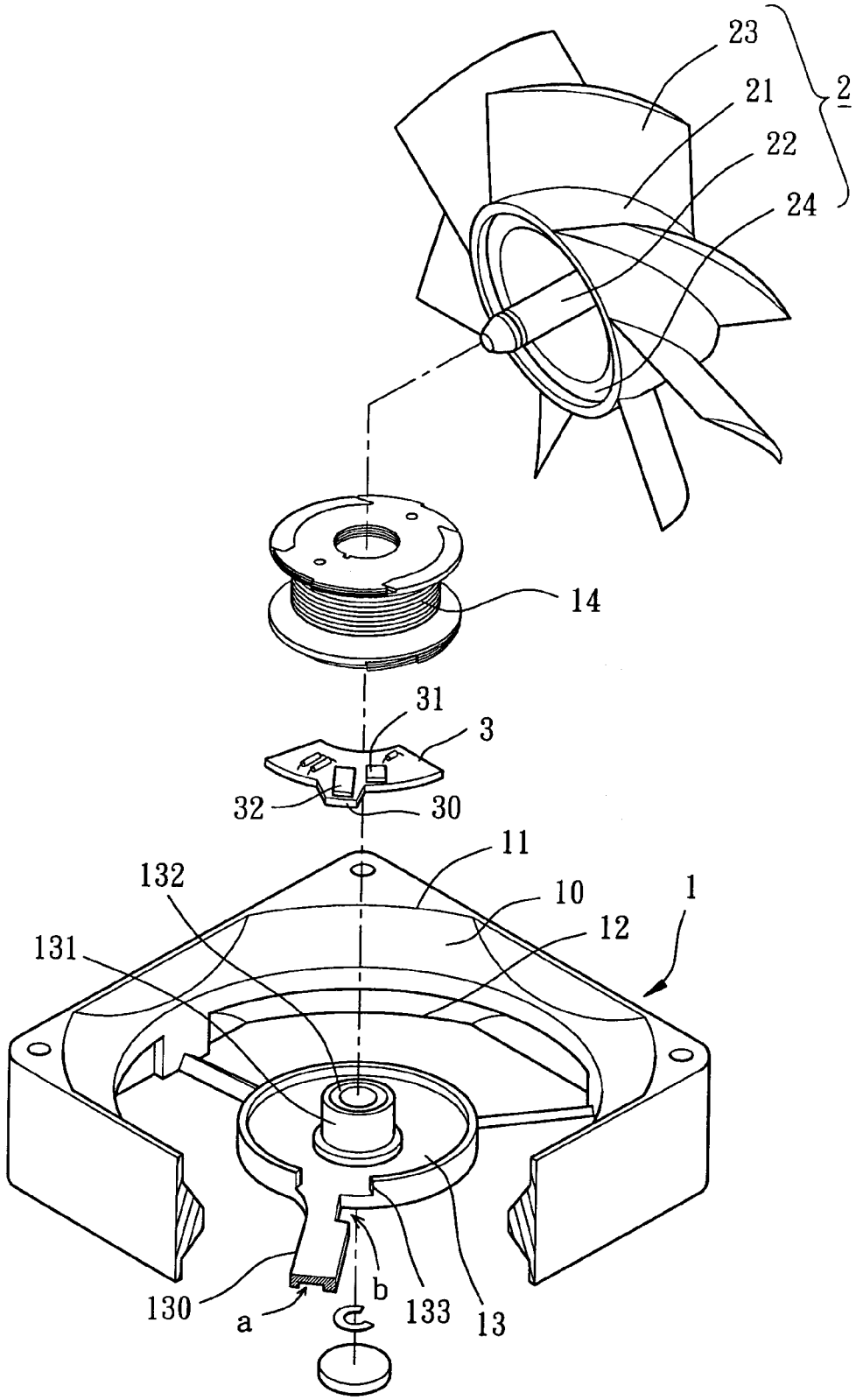
FIG. 2 is an exploded perspective view of a first embodiment of a heat-dissipating fan in accordance with the present invention.

Referring to FIG. 2, a first embodiment of a heat-dissipating fan in accordance with the present invention comprises a housing 1, an impeller 2, and a circuit board 3. The circuit board 3 is in a predetermined position relative to the housing 1 and the impeller 2 to prolong the life of the circuit board 3.

Figure 3:
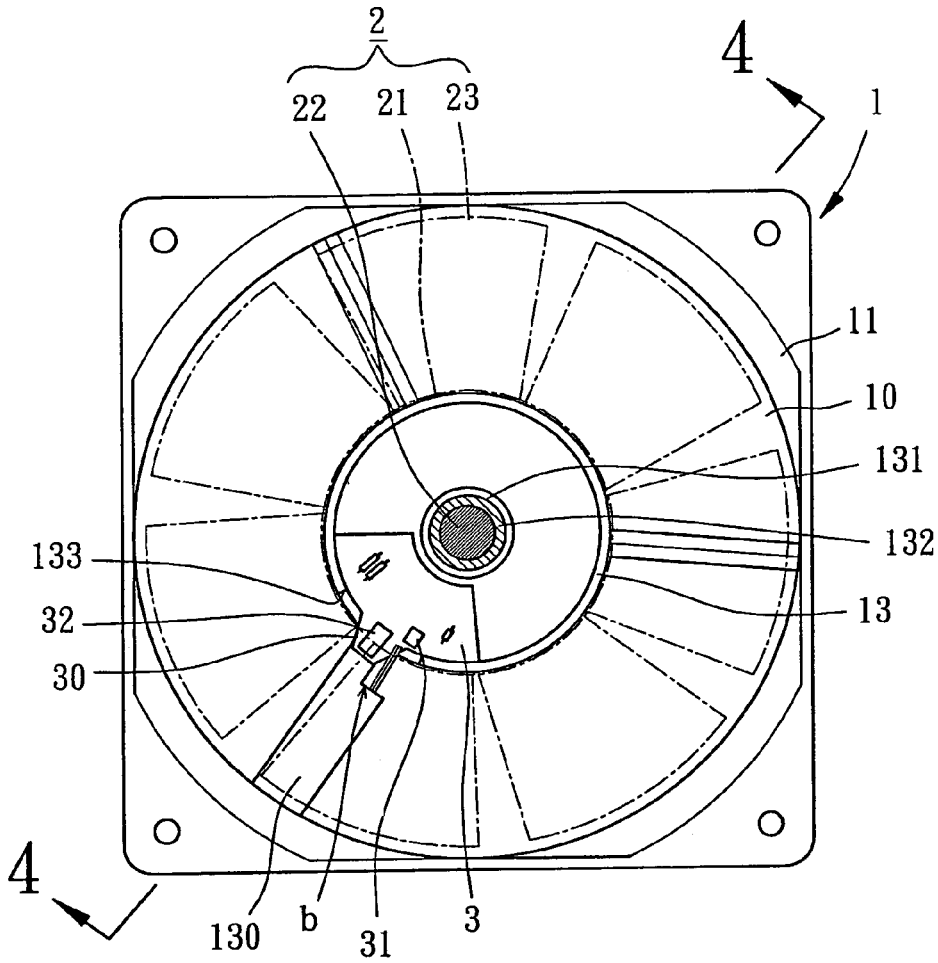
FIG. 3 is a top view of the first embodiment of the heat-dissipating fan in accordance with the present invention.

Referring to FIGS. 2 and 3, the housing 1 of the first embodiment comprises an air channel 10, an air inlet 11, an air outlet 12, and a base 13, and further accommodates a stator 14. The impeller 2 is received in the air channel 10. The air inlet 11 and the air outlet 12 are respectively at two ends of the air channel 10. Air currents enter the air channel 10 via the air inlet 11 and exit the air channel 10 via the air outlet 12.

The base 13 is selectively mounted on the air outlet 12 side or the air inlet 11 side. The base 13 comprises a plurality of ribs 130, an axial tube 131, at least one bearing 132, and at least one notch 133. The ribs 130 are mounted between the base 13 and an inner periphery defining the air channel 10 of the housing 1. At least one of the ribs 130 includes a wire-guiding groove "a" and a wire-guiding notch "b" for guiding a wire (not labeled) connected to the circuit board 3. The axial tube 131 is integrally formed on or coupled to a center of the base 13 and receives the bearing 132. The notch 133 of the base 13 is aligned with one of the ribs 130. Preferably, the notch 133 of the base 13 is aligned with the rib with the wire-guiding groove "a" and the wire-guiding notch "b". The stator 14 and the circuit board 3 are fixed on the base 13 for creating alternate energizing.

Still referring to FIGS. 2 and 3, the impeller 2 of the first embodiment comprises a hub 21, a shaft 22, a plurality of blades 23, and an annular magnet 24. The hub 21 is substantially inverted bowl-like. The shaft 22 extends from a center of an inner face of the hub 21 and is rotatably extended through the bearing 132 in the base 13. The blades 23 are annularly provided on an outer periphery of the hub 21. Preferably, the blades 23 are axial flow type blades. The annular magnet 24 is mounted to an inner periphery of the hub 21 for sensing the alternate energizing created by the stator 14 to thereby drive the impeller 2 to turn. Air currents are thus driven to flow from the air inlet 11 side to the air outlet 12 side.

Still referring to FIGS. 2 and 3, the circuit board 3 of the first embodiment preferably is a rigid printed circuit board that is sectorial or rectangular. The circuit board 3 comprises at least one extension 30, at least one sensor 31, and at least one heat-generating electronic element 32 that generates heat during operation. The circuit board 3 is securely mounted on the base 13 and preferably adjacent to the notch 133, with the extension 30 extending radially out of the base 13 via the notch 133 to the rib 130 aligned with the notch 133. The sensor 31 is mounted on a side of the circuit board 3 and located in a range of the base 13. The sensor 31 is aligned with a bottom face of the annular magnet 24 of the impeller 2. Hence, the senor 31 may detect a change in polarity of the annular magnet 24. The electronic element 32 is mounted on a side of the extension 30 of the circuit board 3 and preferably on the side of the extension that is adjacent to the impeller 2. The electronic element 32 receives a detection signal from the sensor 31 and outputs alternating current to the stator 14. The electronic element 32 may be a transistor or a package of an integrated circuit, such as a field-effect transistor (FET), a metal-oxide semiconductor (MOS), and etc.

Figure 4:
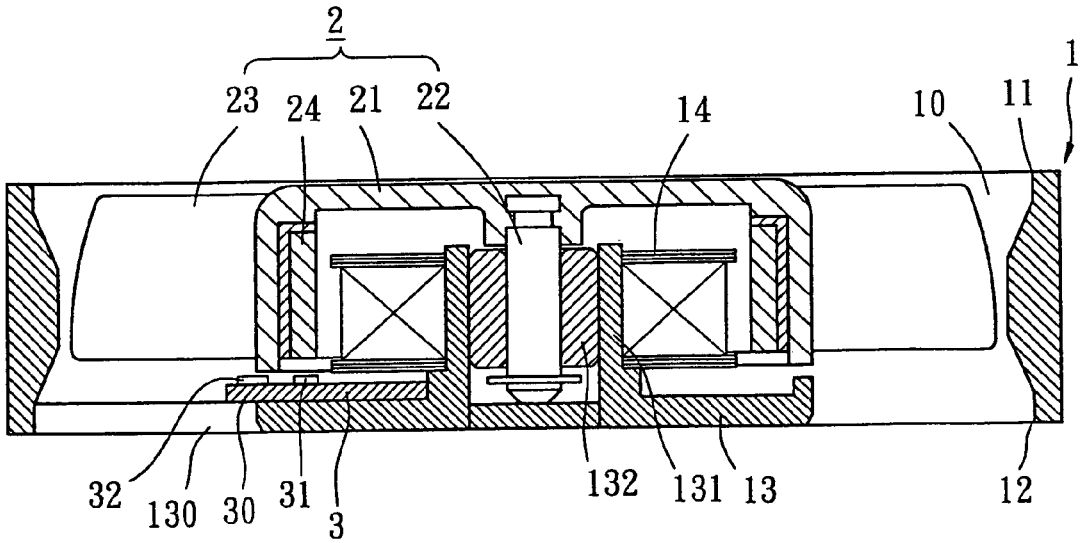
FIG. 4 is a sectional view taken along plane 4-4 in FIG. 3.

Referring to FIGS. 3 and 4, after assembly of the first embodiment of the heat-dissipating fan in accordance with the present invention, the hub 21 of the impeller 2 is substantially axially aligned with the base 13 of the housing 1, and the sensor 31 of the circuit board 3 is substantially axially aligned with the bottom face of the annular magnet 24 of the impeller 2. Further, the extension 30 of the circuit board 3 partially or completely extends out of the hub 21 via the notch 133 along a radial direction of the housing 1 in relation to a longitudinal direction of the housing 1. Preferably, the extension 30 is aligned with the rib 130 with the wire-guiding groove "a" and the wire-guiding notch "b". By this arrangement, at least one portion of the electronic element 32 (or the whole electronic element 32) on the extension 30 is on a downstream side of the blades 23.

Still referring to FIGS. 3 and 4, in operation, the electronic element 32 outputs alternating current to the stator 14 based on the detection signal from the sensor 31, creating alternating magnetic field for driving the impeller 2 to turn. The blades 23 of the impeller 2 drive air currents to flow from the air inlet 11 side to the air outlet side 12. Since at least one portion of the electronic element 32 is on the downstream side of the blades 23, the air currents driven by the blades 23 can be used to dissipate the heat generated by the electronic element 32. Adverse affect to the operational stability or rated output power of the electronic element 32 is avoided. The life of the heat-dissipating fan is prolonged accordingly. Further, in a case that the electronic element 32 is on the rib 130 with the wire-guiding groove "a", the turbulence and noise due to contact between the electronic element 32 and the air currents are reduced, thereby improving the quality of use of the heat-dissipating fan.

Figure 5:
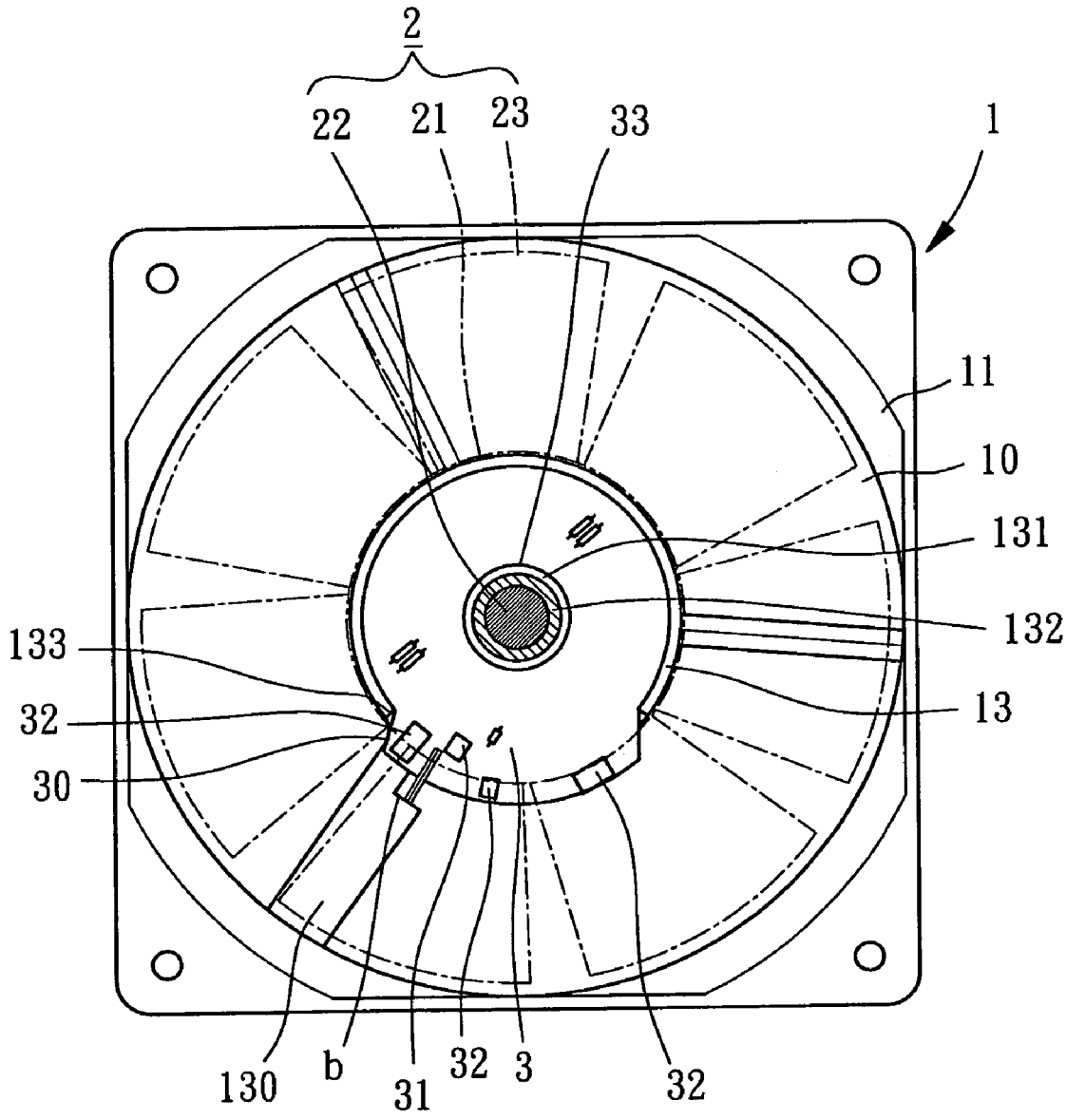
FIG. 5 is a top view of a second embodiment of the heat-dissipating fan in accordance with the present invention.

FIG. 5 shows a second embodiment of the heat-dissipating fan in accordance with the present invention. As compared to the first embodiment, the circuit board 3 of the second embodiment is substantially circular, and the extension 30 may have a larger area according to product need. The extension 30 may extend to a location adjacent to the rib 130, allowing more heat-generating electronic elements 32 to be mounted on the extension 30, with at least one portion of the electronic elements 32 located on the downstream side of the blades 23 for efficient dissipation of heat. Further, the circuit board 3 includes a hole 33 in a center thereof for coupling with the axial tube 131 of the base 13. The second embodiment improves not only the heat-dissipating efficiency of the heat-generating electronic elements 32 but also the assembling reliability of the circuit board 3.

Figure 6:
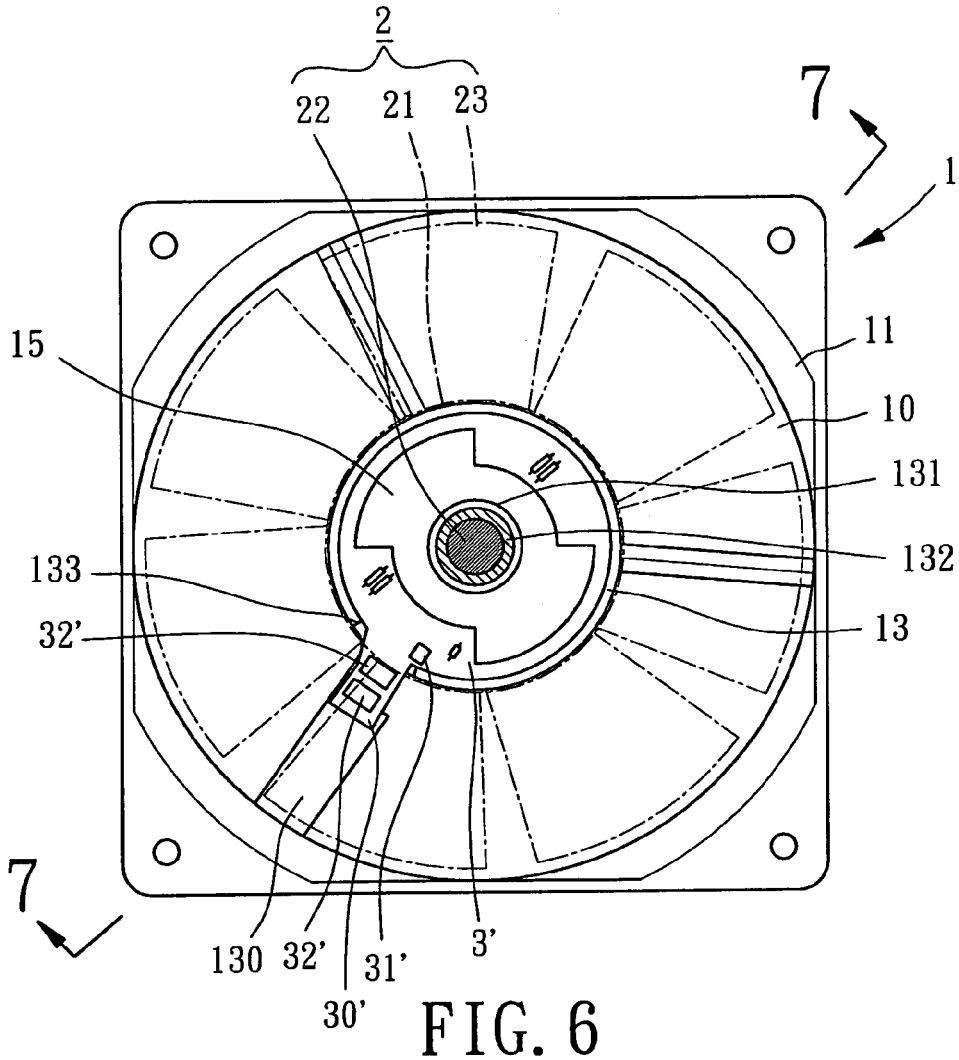
FIG. 6 is a top view of a third embodiment of the heat-dissipating fan in accordance with the present invention.
Figure 7:
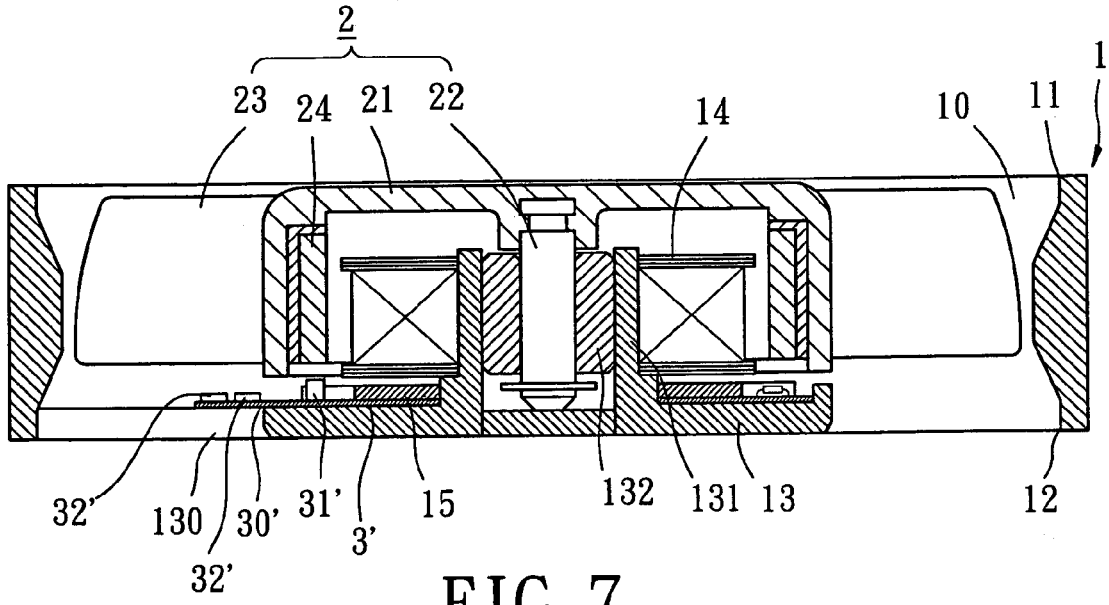
FIG. 7 is a sectional view taken along plane 7-7 in FIG. 6.

FIGS. 6 and 7 show a third embodiment of the heat-dissipating fan in accordance with the present invention. As compared to the first and second embodiments, the circuit board 3' of the third embodiment is a flexible printed circuit board. The circuit board 3' also comprises at least one extension 30', a sensor 31', and at least one heat-generating electronic element 32'. Assembly and heat-dissipating operation of the third embodiment are similar to those of the first and second embodiments. Alternatively, the circuit board 3' may selectively be a combination of a rigid printed circuit board and a flexible printed circuit board. For example, the circuit board 3' is a rigid printed circuit board whereas the extension 30' is a flexible printed circuit board, and vice versa. Since the thickness of a flexible printed circuit board is smaller than that of a rigid one, the space in thickness saved by using a flexible printed circuit board as the extension 30' can be used for mounting at least one electronic element 32 of larger sizes.

Optionally, at least one balancing plate 15 can be mounted on the circuit board 3' for preventing warping of the circuit board 3'. The balancing plate 15 is preferably made of magnetically conductive material such as iron or iron alloy. The balancing plate 15 is aligned with the annular magnet 24. Hence, a magnetic balancing attractive force is provided between the balancing plate 15 and the annular magnet 24. Thus, the third embodiment not only improves the heat-dissipating efficiency and increases mounting space but also enhances the rotational balance of the impeller 2.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A heat-dissipating fan comprising:

a housing including an air inlet, an air channel, an air outlet, and a base having an adapting portion, the air inlet and the outlet being respectively at two ends of the air channel, the base being mounted in one of the ends of the air channel;

an impeller rotatably mounted on the base, the impeller including a hub and a plurality of blades; and a circuit board mounted on the base, the circuit board including at least one heat-generating electronic element mounted thereon, and at least one extension extending radially outward there from, said at least one heat-generating electronic element extending out of the hub by means of the adapting portion of the base in relation to a longitudinal direction of the housing and being mounted on said at least one extension, with at least one portion of said at least one heat-generating electronic element located on a downstream side of the blades and directly exposed to the blade of the impeller for dissipating heat generated by said at least one heat-generating electronic element.

2. The heat-dissipating fan as claimed in claim 1, wherein said at least one heat-generating electronic element is mounted on a side of said at least one extension that is adjacent to the impeller.

3. The heat-dissipating fan as claimed in claim 1, wherein the adapting portion of the base further comprises at least one notch through which said at least one extension and said at least one heat-generating electronic element extend.

4. The heat-dissipating fan as claimed in claim 3, further comprising a plurality of ribs connected between the base and an inner periphery delimiting the air channel, at least one of the ribs being aligned with said at least one notch, allowing said at least one extension and said at least one heat generating electronic element to extend to said at least one rib.

5. The heat-dissipating fan as claimed in claim 4, wherein said at least one rib comprises a wire-guiding groove and a wire-guiding notch for receiving a wire connected to the circuit board, and wherein said at least one notch of the base is aligned with said at least one rib with the wire-guiding groove.

* * * * *